United States Patent [19]

Underwood et al.

[11] Patent Number: 4,993,129

[45] Date of Patent: Feb. 19, 1991

[54] CASKET HAVING THORACIC ADJUSTMENT

[75] Inventors: Benjamin A. Underwood, 7304 Hunting Creek Dr., Prospect, Ky. 40059; Richard K. Merryweather, Louisville, Ky.

[73] Assignee: Benjamin A. Underwood, Prospect, Ky.

[21] Appl. No.: 373,516

[22] Filed: Jun. 30, 1989

[51] Int. Cl.[5] ..... A61G 17/00

[52] U.S. Cl. ..... 27/12; 5/63; 5/79

[58] Field of Search ..... 27/12, 13, 28, 2; 5/63, 5/66, 70, 72, 79

[56] References Cited

U.S. PATENT DOCUMENTS

| | | | |
|---|---|---|---|
| 1,840,675 | 1/1932 | Letzig | 27/12 |
| 2,735,157 | 2/1956 | Hochkiss et al. | 27/12 |
| 4,044,436 | 8/1977 | Patrick | 27/12 |

*Primary Examiner*—Richard E. Chilcot, Jr.

*Attorney, Agent, or Firm*—Berman, Aisenberg & Platt

[57] ABSTRACT

A casket bed comprises a mechanism for vertically adjusting the thoracic area of a body. The bed comprises two parts connected by a hinge and arranged such that the hinge may be raised with respect to the ends of the bed. The hinge is located along the bed such that it is adjacent the thoracic area of a body whereby vertical adjustment of the hinge adjusts the position of the thoracic area.

12 Claims, 3 Drawing Sheets

CASKET HAVING THORACIC ADJUSTMENT

TECHNICAL FIELD

This invention relates to the art of undertaking. In particular, the invention is a casket or an attachment for a casket which provides for unique positioning of the thoracic area of a body.

BACKGROUND ART

It is known to provide an adjustable spring or platform on which a body lies in a casket. These adjustable platforms generally provide only for raising or lowering of the head or foot portions of the body and do not provide for adjustment of the portions of the body intermediate the head and the feet. For example, the casket beds shown in U.S. Pat. Nos. 4,403,380 (Hazelett et al.) and 1,934,425 (Harms) provide mechanisms for raising or lowering the head or foot portions but have no provisions for adjusting the position of the intermediate parts of the body.

Arrangements are known for adjusting the position of the head and shoulders or for rotating the body about the longitudinal axis of the casket. U.S. Pat. No. 965,641 (Lynch) shows a casket having a first board hinged to a midpoint of the bottom of the casket and a second board hinged to the first board whereby these boards may be moved upward to raise the head and shoulders of the body. U.S. Pat. Nos. 1,840,675 (Letzig) and 2,735,157 (Hotchkiss) show systems similar to that of Lynch wherein the first and second boards are connected to each other, and the vertical position of the boards is adjustable.

U.S. Pat. No. 1,661,377 (Lutz) shows an arrangement wherein a support for the head and a support for the back are pivotally attached to a frame which is pivotally supported on the bottom of the casket.

U.S. Pat. No. 4,044,436 (Patrick) shows a suspension system for a body which comprises a flexible wire fabric supported on the sides of the casket at a number of locations.

SUMMARY OF THE INVENTION

The devices known in the prior art do not provide adjustment of the thoracic area of a body. The structures shown by Lynch, Letzig, Hotchkiss, and Lutz cannot raise the thoracic area independently of the remainder of the body, and the Patrick device is complicated and requires several adjustments. These are important deficiencies in the art because it is often necessary for the thoracic area of the body to be positioned to result in the proper appearance of the body in the casket. The widespread practice today is to stuff newspapers between the thoracic area of the body and the mattress to raise the thoracic area when placing the body in the casket.

In accordance with the invention, a casket is provided with a platform, or bed, consisting of two parts. A first part supports the head and shoulders of a body, while the second part supports the remaining portion of the body. The first and second parts are hinged at a location which is substantially adjacent the thoracic area of the body such that this portion of the body may be raised independently of the head or feet. This allows the mortician to adjust the overall height of the body, the position of the head and feet, and the position of the thoracic area to provide for appealing placement of the body in the casket.

In a preferred embodiment, the mechanism for adjusting the height of the connection between the two parts comprises a curved strap which extends from an adjustable connection at the head of the casket, engages the casket bed at the hinged connection, and engages the bottom of the casket at a sliding "foot". The adjustable connection is easily accessed from the top of the casket and is arranged so that vertical movement of this connection moves the hinged connection of the two parts of the bed vertically to adjust easily the thoracic area of the body. The adjustable connection preferably comprises a threaded block which is carried by a screw. The screw extends vertically and is easily accessible to the mortician so that rotation of the screw moves the block up or down and accordingly moves the curved strip of metal up or down to adjust the vertical position of the hinged connection between the first and second parts of the platform.

In accordance with a second embodiment, two rods are connected to the hinged connection at their first ends, while second ends are connected to a screw attached to the bottom of the casket for varying the distance between the second ends. As the second ends are moved toward or away from each other, the distance between the hinged connection and the bottom of the casket is varied.

By either of these constructions, the thoracic area of the body is easily adjusted to compensate for any deformation of the body which has occurred.

The platform and adjusting mechanism of the invention may be supplied in combination with the casket, or they may be supplied separately for installation into a variety of caskets.

It is an object of this invention to provide a unique arrangement for adjusting the position of the thoracic area of a body when lying in a casket.

DETAILED DESCRIPTION OF THE PREFERRED EMBODIMENTS

Figure 1:
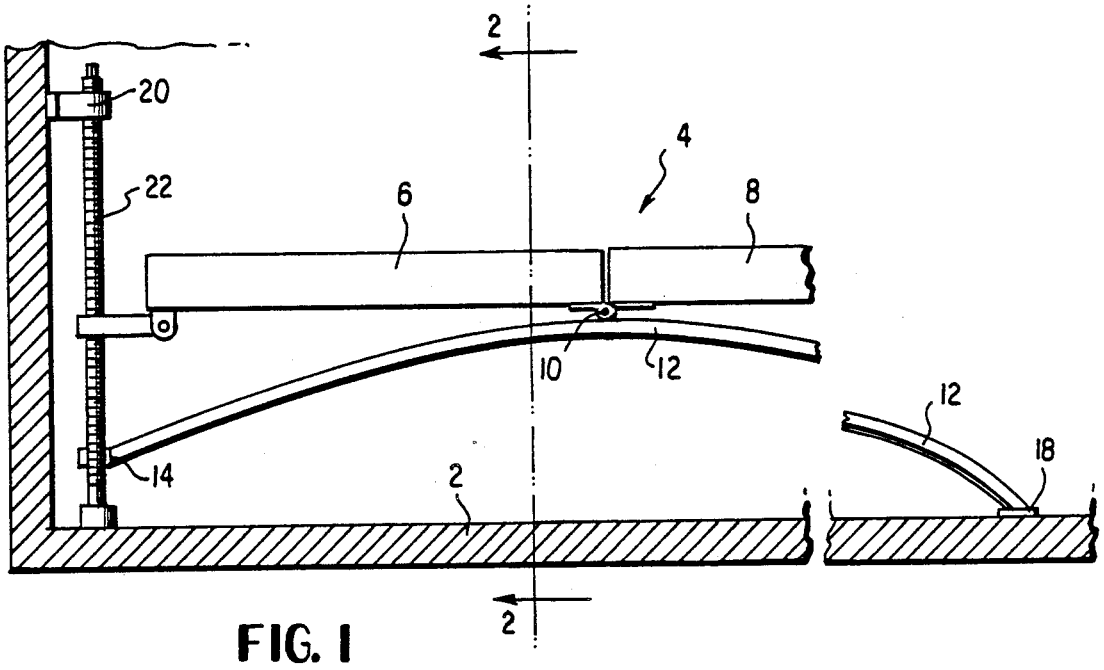
FIG. 1 is a side view of a mechanism for adjusting the thoracic area of a body showing a casket in longitudinal cross section.

With reference to FIG. 1, a casket 2 is shown in longitudinal cross section having a bed 4 for supporting a body thereon. Bed 4 comprises a first part 6 and a second part 8 which are connected to each other by a hinge 10. Hinge 10 is located with respect to the total length of the bed such that it will be beneath the thoracic area of a body lying on the bed. For, example, if the overall length of the bed is 72 inches, the length of the first part will be about seventeen inches while the length of the second part will be about 54 inches. The hinge is, thus, located at about one quarter of the distance from the head of the bed to the foot. A preferred range is from 20 to 25 percent.

In addition, the hinge is mounted such that the two parts of the bed can pivot with respect to each other whereby the hinge can raise or lower freely. As shown, the hinge is attached to the bottom of the bed to permit the hinge to be raised by a large degree from the position shown and lowered somewhat. Generally, the desired adjustment is to raise the thoracic area, and this arrangement is useful. It is within the contemplation of the invention to provide other arrangements which permit raising and lowering the thoracic area by significant amounts.

A curved strap 12 is mounted beneath the bed and engages the bed at about the hinge 10. The head end of the strap 12 is connected to a threaded block 14 which is in turn carried by a threaded rod 16. The opposed end of strap 12 terminates in a sliding foot 18 which engages the bottom of the casket and slides therealong. Threaded rod 16 is mounted to the head end of the casket by pillow blocks 20, and the upper end of threaded rod 16 may have a hexagonal hole to facilitate rotation of the rod by a similarly shaped wrench.

As the threaded block 14 is raised or lowered, the point of engagement between strap 12 and bed 4 raises or lowers and strap 12 pivots about foot 18. As the point of engagement raises or lowers, the hinged connection between parts 6 and 8 raises or lowers, thus adjusting the vertical position of the thoracic area of a body lying on the bed.

Figure 2:
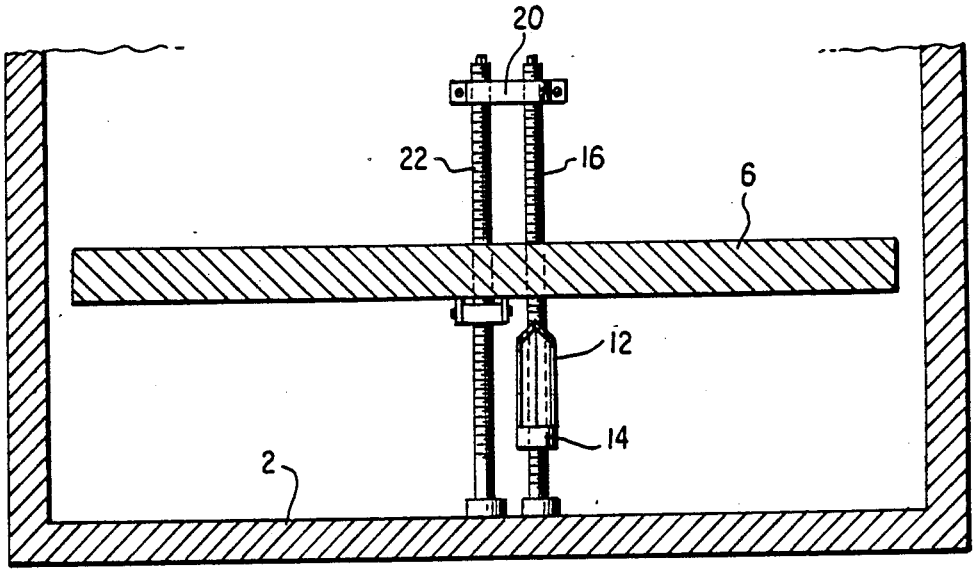
FIG. 2 is a cross section taken along line 2—2 of FIG. 1.

FIG. 2 shows the placement of threaded rod 16 with respect to another threaded rod 22 which is used to raise or lower the head end of first part 6. Preferably threaded rod 22 and its associated mechanism is similar to that shown in U.S. Pat. No. 4,403,380 (Hazelett et al.).

In a preferred embodiment, the curved strap 12 is a piece of angle iron mounted such that the vertex of the angle engages the hinge 10.

Figure 3:
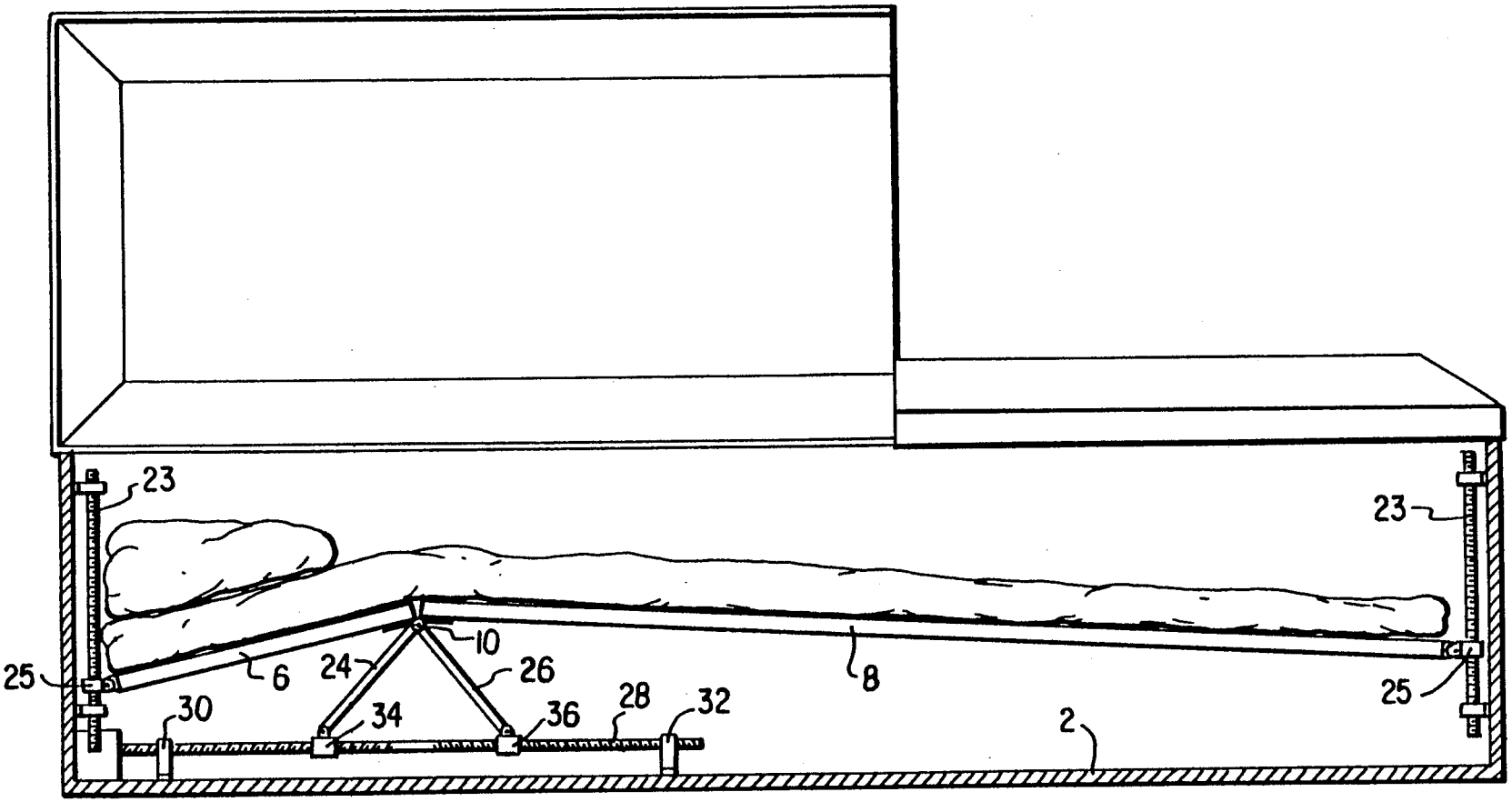
FIG. 3 is a side view of a second embodiment of a mechanism for adjusting the thoracic area of a body showing a casket in longitudinal cross section.
Figure 4:
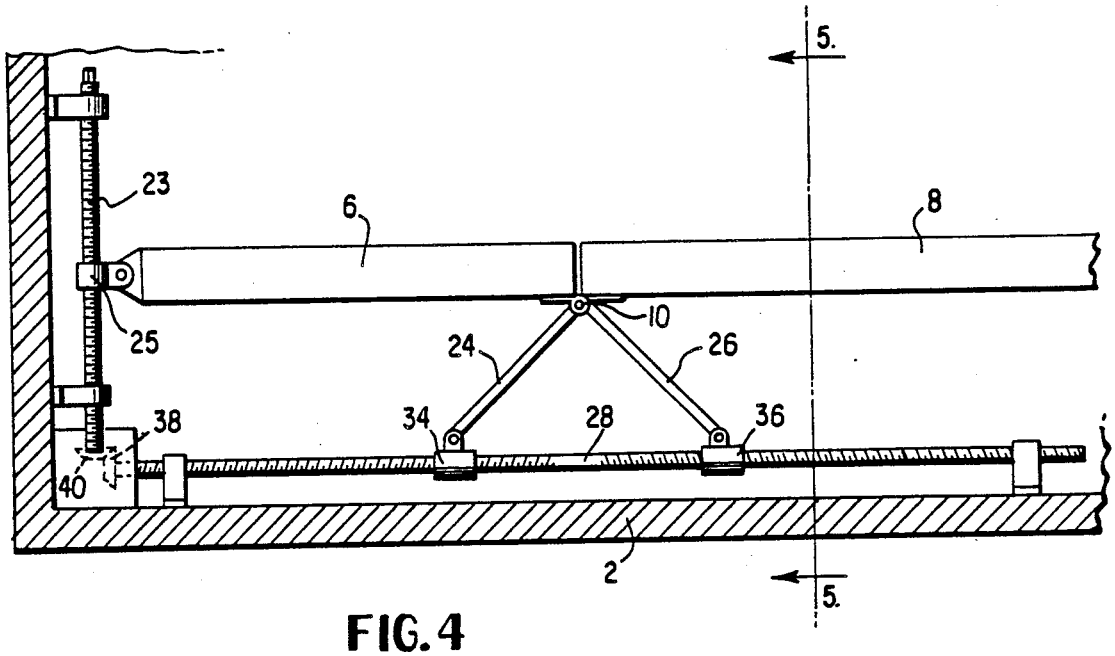
FIG. 4 is an enlarged side view of the mechanism shown in FIG. 3.
Figure 5:
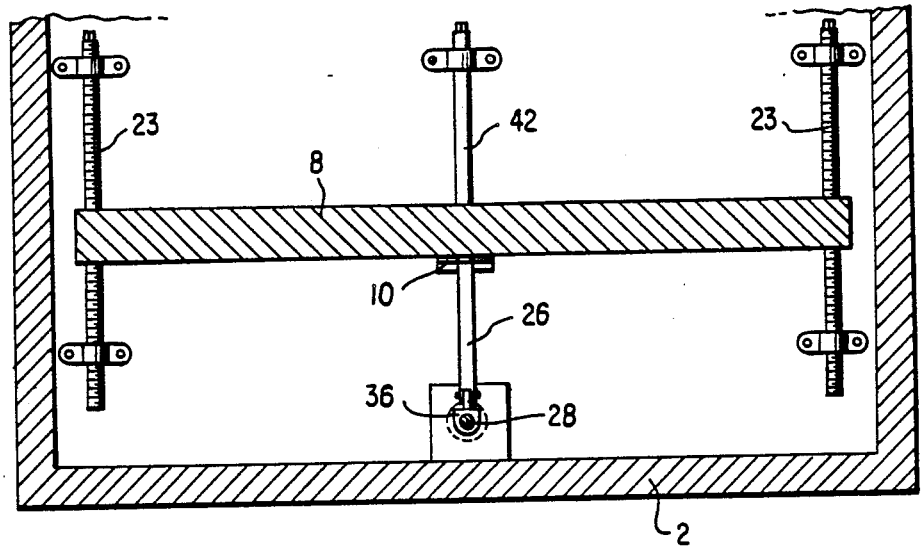
FIG. 5 is a cross section taken along line 5—5 of FIG. 4.

A second embodiment is shown in FIGS. 3–5 and includes first support 24 and second support 26. Upper ends of supports 24 and 26 are connected to the bed at or near the hinge. As shown, the hinge pin for the hinge also receives the upper ends of the supports 24 and 26. A rod 28 is mounted to the bottom of the casket by pillow blocks 30 and 32, and the lower ends of the supports are connected to the rod 28 by threaded blocks 34 and 36, respectively. The part of rod 28 which engages block 34 is threaded in one direction (e.g. left handed) while the part of rod 28 which engages block 36 is threaded in the opposite direction (e.g. right handed). As rod 28 is rotated, blocks 34 and 36 move toward or away from each other to vary the distance between the lower ends of the supports 24 and 26 to raise or lower the hinge and, thus, the thoracic area of a body on the bed.

The head and foot parts of the bed are supported by threaded rods 23 which carry threaded blocks 25 for raising or lowering these parts of the bed.

Rod 28 has a bevel gear 38 at one end which engages a bevel gear 40 which is in turn attached to a rod 42. Rotation of rod 42 rotates rod 28 through the interaction between the bevel gears 38 and 40. Thus, the height of the hinge 10 is easily adjusted by rotation of rod 42 with a wrench or other tool.

It will be appreciated that a unique arrangement for a casket has been described wherein the position of the thoracic area of a body is easily adjusted. This in combination with known devices for adjusting the head and foot of the bed results in a unique bed which greatly facilitates the positioning of a body. Modifications within the scope of the appended claims will be apparent to those of skill in the art.

We claim:

1. Apparatus for providing adjustment of the thoracic area of a human body comprising bed means for supporting said body, said bed means comprising first and second parts connected to each other by pivot means for permitting said first part to pivot with respect to said second part, and positioning means for vertically positioning said pivot means with respect to opposed ends of said bed, wherein said pivot means is positioned along said bed means to be adjacent said thoracic area.

2. Apparatus according to claim 1 wherein the length of said first part comprises about twenty five percent of the overall length of said bed.

3. Apparatus according to claim 2 further comprising casket means containing said bed means.

4. Apparatus according to claim 3 further comprising adjusting means for adjusting the height of said opposed ends of said bed with respect to said casket.

5. Apparatus according to claim 2 wherein said positioning means comprises means for engaging the bottom of a casket and said pivot means for varying the distance between said bottom and said pivot means.

6. Apparatus for providing adjustment of the thoracic area of a human body comprising bed means for supporting said body, said bed means comprising first and second parts connected to each other by pivot means for permitting said first part to pivot with respect to said second part, and positioning means for vertically positioning said pivot means with respect to opposed ends of said bed, wherein said pivot means is positioned along said bed means to be adjacent said thoracic area, the length of said first part comprising about twenty five percent of the overall length of said bed, said positioning means comprises means for engaging the bottom of a casket and said pivot means for varying the distance between said bottom and said pivot means and wherein said positioning means comprises first and second supports connected at first ends to said bed means and second ends for connection to said bottom of said casket and means for varying the distance between said second ends.

7. Apparatus according to claim 6 wherein said second ends are connected to a threaded rod for mounting to said bottom of said casket.

8. Apparatus for providing adjustment of the thoracic area of a human body comprising bed means for supporting said body, said bed means comprising first and second parts connected to each other by pivot means for permitting said first part to pivot with respect to said second part, and positioning means for vertically positioning said pivot means with respect to opposed ends of said bed, wherein said pivot means is positioned along said bed means to be adjacent said thoracic area, the length of said first part comprising about twenty five percent of the overall length of said bed, said positioning means comprises means for engaging the bottom of a casket and said pivot means for varying the distance between said bottom and said pivot means and wherein said positioning means comprises strap means forming an arch for extending from a first location near one end of said bed to a second location for contacting the bottom of said casket and for contacting said pivot means at a location intermediate said ends.

9. Apparatus according to claim 8 further comprising means for vertically adjusting said strap means.

10. Apparatus according to claim 9 wherein said means for vertically adjusting comprises means for vertically adjusting said first location.

11. Apparatus according to claim 10 further comprising said casket.

12. Apparatus according to claim 7 further comprising said casket.

* * * * *